US005938546A

United States Patent [19]

Caruso

[11] Patent Number: 5,938,546

[45] Date of Patent: Aug. 17, 1999

[54] APPARATUS FOR REBOUNDING BALLS

[76] Inventor: Anthony Caruso, c/o Kwik Goal Ltd., 140 Pacific Dr., Quakertown, Pa. 18951

[21] Appl. No.: 08/992,784

[22] Filed: Dec. 17, 1997

[51] Int. Cl.[6] ..... A63B 69/00

[52] U.S. Cl. ..... 473/434; 473/454

[58] Field of Search ..... 473/421, 422, 473/434, 435, 439, 454, 456, 462, 481, 115, 112

[56] References Cited

U.S. PATENT DOCUMENTS

| | | | |
|---|---|---|---|
| 2,161,463 | 6/1939 | Forest | 473/434 |
| 2,162,438 | 6/1939 | Letarte | 473/454 |
| 2,944,816 | 7/1960 | Dixon | 473/435 |
| 3,672,672 | 6/1972 | Rubin | 473/435 |
| 3,836,144 | 9/1974 | Mahoney | 473/435 |
| 4,239,235 | 12/1980 | Torres | 473/434 |
| 4,523,760 | 6/1985 | Bednaiczuk | 473/421 |
| 4,553,751 | 11/1985 | Ketchum . | |
| 4,650,189 | 3/1987 | Rajacich . | |
| 5,088,740 | 2/1992 | Peterson | 473/421 |
| 5,269,527 | 12/1993 | Noval | 473/421 |
| 5,308,083 | 5/1994 | Grunfeld . | |
| 5,407,211 | 4/1995 | Bottiglieri | 473/421 |
| 5,516,115 | 5/1996 | McLain . | |
| 5,556,104 | 9/1996 | Guillen | 473/435 |

*Primary Examiner*—William M. Pierce
*Attorney, Agent, or Firm*—Richard L. Miller, P.E.

[57] ABSTRACT

An apparatus for rebounding balls that includes a frame and a net structure within the frame, and has an upright position, a rear down position, and a front down position so as to allow the apparatus to be used in a variety of positions. The frame is unitary and tubular and comprises a front section that is planar and vertically rearwardly inclined, and a rear section that has an upper portion diverging downwardly rearwardly from the front section of the frame and forms an acute angle therebetween and a lower portion diverging downwardly rearwardly from the upper portion of the rear section of the frame. The net structure comprises a front net section that is planar, positioned within, and sized to conform to, the front section of the frame, and a rear net section positioned within, and sized to conform to, the rear section of the frame, and which is independent of the front net section of the net structure, with the net structure being secured in taut condition within the frame by rubber straps.

17 Claims, 1 Drawing Sheet

APPARATUS FOR REBOUNDING BALLS

BACKGROUND OF THE INVENTION

1. Field of the Invention

The present invention relates to a rebound apparatus. More particularly, the present invention relates to an apparatus for rebounding balls.

2. Description of the Prior Art

Numerous innovations for rebound apparatus have been provided in the prior art that will be described. Even though these innovations may be suitable for the specific individual purposes to which they address, however, they differ from the present invention.

FOR EXAMPLE, U.S. Pat. No. 4,553,751 to Ketchum teaches an angularly adjustable rebound apparatus for athletic training. A generally rectangular front frame carries a rebound net and is spring-mounted on a similar back frame. Behind the back frame a rigid support base presents generally triangular opposite sides, each having a horizontal bottom side rail, a front side rail extending up from the front end of the corresponding bottom side rail, and a diagonal side rail extending down from the upper end of the front side rail to the rear end of the bottom side rail. Each bottom side rail has top openings at intervals along its length for receiving a locking pin on a corresponding slider. Each slider carries the socket of a ball-and-socket joint which connects the slider to the rear end of a rigid rod which is pivotally connected at its front end to the lower end of the back frame.

ANOTHER EXAMPLE, U.S. Pat. No. 4,650,189 to Rajacich teaches a recreational apparatus for rebounding balls, and the like, thrown against it. The apparatus is constructed comprising three net planes and four playing surfaces so that two players may simultaneously use the apparatus by playing on opposite sides thereof. The frame has horizontal bars and side legs and can be separated into portions for breakdown purposes. Each of the three net sections is attached to the frame by spaced resilient members.

STILL ANOTHER EXAMPLE, U.S. Pat. No. 5,308,083 to Grunfeld et al. teaches a portable soccer goal with rebounding net to return a ball struck into the net. The frame of the goal is formed by a pair of vertical posts and a long horizontal tube and is secured to the ground by a pair of the base supports. Pivotable struts further support the vertical posts. The net has a sleeve that positively joins the net to the frame over the entire horizontal length of the frame, and there is a resilient mainstay cord threaded into the net near the periphery. The net and mainstay cord are secured by hooks at the base supports, and the net is oriented to the outside of the struts. When the struts are spread outwards, the tension in the net is increased so as to be sufficient to rebound a ball struck into the net.

YET ANOTHER EXAMPLE, U.S. Pat. No. 5,516,115 to McLain teaches a portable practice target, for propelled balls, that includes a light-weight plastic tubing and fittings framework that supports a front and a rear panel in an essentially vertical position. Three edges of the panels are attached together so that the panels fit over the vertical support like a sock or pillow case. The front panel can have a central pocket and the rear panel can have a central opening so that when the panels are positioned over the vertical support, the front panel pocket can be threaded through the rear panel opening. Adjustable strips can be used as a target area and means for adjusting the size of the pocket opening. The framework vertical support can be held in place by angled or adjustable couplings that permit the angle between the horizontal plane and the panels to be adjusted. The panels can be made resilient and elastic to rebound any ball that does not enter the pocket.

FINALLY, STILL YET ANOTHER EXAMPLE, U.S. Pat. No. 5,556,104 to Guillen, Jr. teaches a practice device for practicing soccer ball kicking and passing techniques comprising essentially a frame and a rebound surface and optional netting. When the practice device is positioned at a certain distance from the practicing student and the soccer ball is kicked or passed to the practice device, the soccer ball impacts the solid upright portion of the device and then rebounds back to the soccer student thereby challenging his kicking accuracy and response reflex while minimizing his efforts to retrieve the soccer ball. The device is particularly suitable for the training of younger students to improve their soccer skills and technical abilities.

It is apparent that numerous innovations for rebound apparatus have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an apparatus for rebounding balls that avoids the disadvantages of the prior art.

ANOTHER OBJECT of the present invention is to provide an apparatus for rebounding balls that is simple and inexpensive to manufacture.

STILL ANOTHER OBJECT of the present invention is to provide an apparatus for rebounding balls that is simple to use.

BRIEFLY STATED, YET ANOTHER OBJECT of the present invention is to provide an apparatus for rebounding balls that includes a frame and a net structure within the frame, and has an upright position, a rear down position, and a front down position so as to allow the apparatus to be used in a variety of positions. The frame is unitary and tubular and comprises a front section that is planar and vertically rearwardly inclined, and a rear section that has an upper portion diverging downwardly rearwardly from the front section of the frame and forms an acute angle therebetween and a lower portion diverging downwardly rearwardly from the upper portion of the rear section of the frame. The net structure comprises a front net section that is planar, positioned within, and sized to conform to, the front section of the frame, and a rear net section positioned within, and sized to conform to, the rear section of the frame, and which is independent of the front net section of the net structure, with the net structure being secured in taut condition within the frame by rubber straps.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
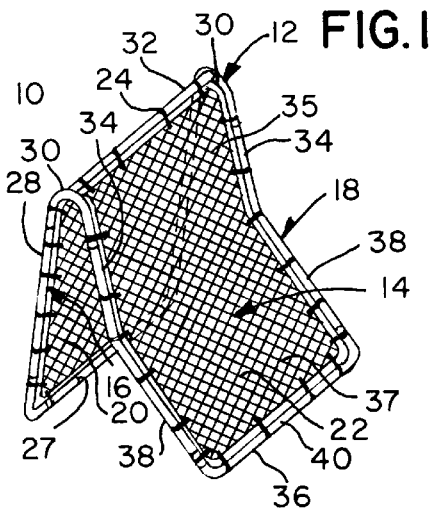
FIG. 1 is a diagrammatic rear perspective view of the present invention.
Figure 2:
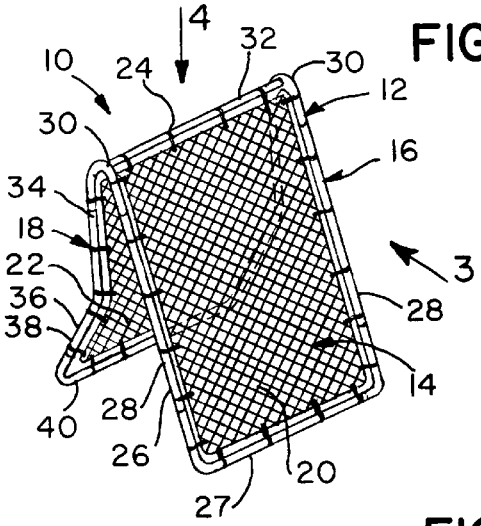
FIG. 2 is a diagrammatic front perspective view of the present invention.
Figure 3:
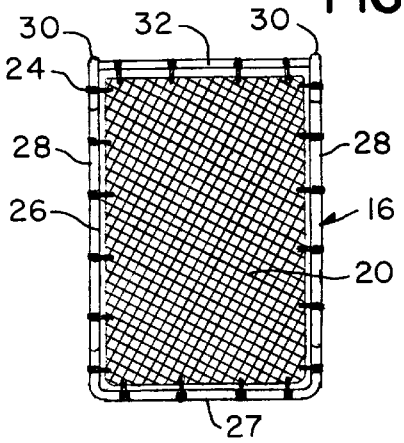
FIG. 3 is a diagrammatic front elevational view taken generally in the direction of arrow 3 in FIG. 2.
Figure 4:
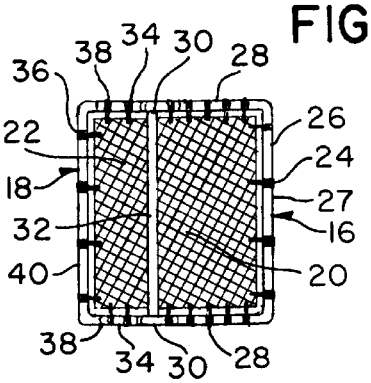
FIG. 4 is a diagrammatic top plan view taken generally in the direction of arrow 4 in FIG. 2.

10 apparatus for rebounding balls of the present invention
12 frame
14 net structure
16 front section of frame 12
18 rear section of frame 12
20 front net section of net structure 14
22 rear net section of net structure 14
24 rubber straps
26 U-shaped member of front section 16 of frame 12
27 horizontal transverse portion of front section 16 of frame 12
28 vertical leg portions of front section 16 of frame 12
30 apex portions of frame 12
32 horizontal cross member of frame 12
34 pair of members of rear section 18 of frame 12
35 rear net section upper portion of rear net section 22 of net structure 14
36 U-shaped member of rear section 18 of frame 12
37 rear net section lower portion of rear net section 22 of net structure 14
38 vertical leg portions of U-shaped member 36 of rear section 18 of frame 12
40 horizontal transverse member of U-shaped member 36 of rear section 18 of frame 12
42 horizontal surface
44 basket ball
46 soft balls

DETAILED DESCRIPTION OF THE PREFERRED EMBODIMENT

Referring now to the figures in which like numerals indicate like part, and particularly to FIGS. 1–4, the apparatus for rebounding balls of the present invention is, shown generally at 10 and comprises a frame 12 and a net structure 14 within the frame 12, and has an upright position, a rear down position, and a front down position.

For the sake of clarity, the configuration of the apparatus for rebounding balls 10 will be described infra when it is in the upright position, bearing in mind that the rear down position and the front down position are merely different orientations of the apparatus for rebounding balls 10 without any change in its structure, and which will be described further infra.

The frame 12 is unitary and tubular and comprises a front section 16 that is planar and vertically rearwardly inclined, and a rear section 18 that diverges downwardly rearwardly from the front section 16 of the frame 12 and forms an acute angle therebetween.

The net structure 14 comprises a front net section 20 that is planar, positioned within, and sized to conform to, the front section 16 of the frame 12, and a rear net section 22 positioned within, and sized to conform to, the rear section 18 of the frame 12, and which is independent of the front net section 20 of the net structure 14, with the net structure 14 being secured in taut condition within the frame 12 by rubber straps 24 which will be described further infra.

The frame 12 is preferably constructed of fourteen gauge, one and one-half inch diameter tubular steel, although other metals and materials of differing gauges and forms may be utilized, while the net structure 14 is preferably constructed of nylon mesh having one and seven-eights inch square mesh, although other materials and other sizes of mesh may be utilized, including tightly-constructed material, without departing in any way from the spirit of the present invention.

The front section 16 of the frame 12 comprises a U-shaped member 26 whose horizontal transverse portion 27 is for resting on a horizontal surface and whose vertical leg portions 28 extend vertically-rearwardly-upwardly from opposite ends of the horizontal transverse portion 27 of the front section 16 of the frame 12, and which terminate in apex portions 30 that are rearwardly facing, convexo-concave-shaped, and coplanar with the vertical leg portions 28 of the front section 16 of the frame 12, and which span less than 90 degrees.

The frame 12 further comprises a horizontal cross member 32 that extends from one apex portion of the apex portions 30 of the frame 12 to the other apex portion of the apex portions 30 of the frame 12, and is parallel to the horizontal transverse portion 27 of the front section 16 of the frame 12 so as to form a rectilinear shape for the front section 16 of the frame 12.

The rear section 18 of the frame 12 comprises a pair of members 34 that are parallel and depend coplanarly and rearwardly, at acute angles, from the other ends of the apex portions 30 of the frame 12, and together with the vertical leg portions 28 of the front section 16 of the frame 12 form equal angles with perpendicular bisectors of the apex portions 30 of the frame 12, with that portion of the rear net section 22 of the net structure 14 therebetween forming a rear net section upper portion 35 that is planar.

The rear section 18 of the frame 12 further comprises a U-shaped member 36 whose vertical leg portions 38 depend coplanarly and rearwardly, at obtuse angles, from the other ends of the pair of members 34 of the rear section 18 of the frame 12, and whose horizontal transverse member 40 is for resting on the horizontal surface, and with that portion of the rear net section 22 of the net structure 14 therebetween forming a rear net section lower portion 37 that is planar.

The rubber straps 24 are preferably three-quarter inch and are of sufficient number to allow the net structure 14 to be amply attached and conform to the shape of the frame 12. In the alternative, the rubber straps 24 can be replaced with springs, with on ends thereof attached to the net structure 12 and the other ends thereof attached to the frame 12.

It is contemplated that the frame 12 may be constructed by bending tubular metal pipe to the proper configuration by use of a hydraulic device and then welding the tubular pipe as necessary or in the alternative, by PVC pipes assembled to the proper configuration. Through the use of these types of construction, the apparatus for rebounding balls 10 is fabricated so as not to require nuts, bolts, clamps, or similar assembly devices. This reduces the time necessary for assembly and disassembly of the frame 12 by the user and eliminates unnecessary parts which may loosen, break, or become lost.

The operation of the apparatus for rebounding balls 10 can best be seen in FIGS. 5–7, and as such will be discussed with reference thereto.

Figure 5:
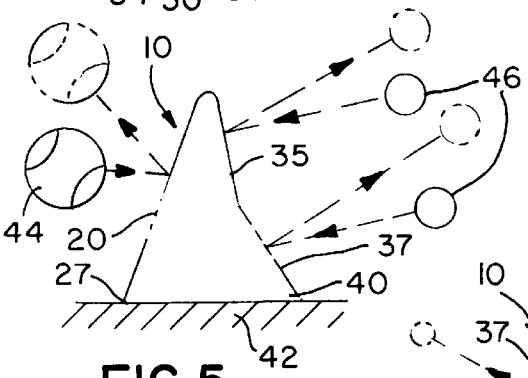
FIG. 5 is a diagrammatic side elevational view of the present invention standing upright and rebounding a basket ball off one side thereof and a softball off the other side thereof.

As shown in FIG. 5, in which the apparatus for rebounding balls 10 is in the upright position, in which the horizontal transverse portion 27 of the front section 16 of the frame 12 and the horizontal transverse member 40 of the U-shaped member 36 of the rear section 18 of the frame 12 are resting on the horizontal surface 42, a basket ball 44 is rebounding off the front net section 20 of the net structure 14, while soft balls 46 are rebounding off both the rear net section upper portion 35 and the rear net section lower portion 37 of the rear net section 22 of the net structure 14, respectively.

Figure 6:
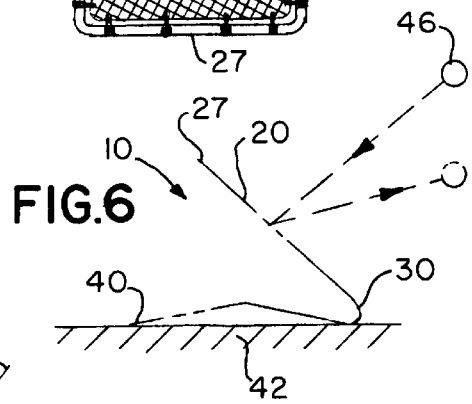
FIG. 6 is a diagrammatic side elevational view of the present invention lying on its back and rebounding a softball off its front.

As shown in FIG. 6, in which the apparatus for rebounding balls 10 is in the rear down position, in which the horizontal transverse member 40 of the U-shaped member 36 of the rear section 18 of the frame 12 and the apex portions 30 of the frame 12 are resting on the horizontal surface 42 with the horizontal transverse portion 27 of the front section 16 of the frame 12 being in the air, the soft ball 46 is rebounding off the front net section 20 of the net structure 14.

Figure 7:
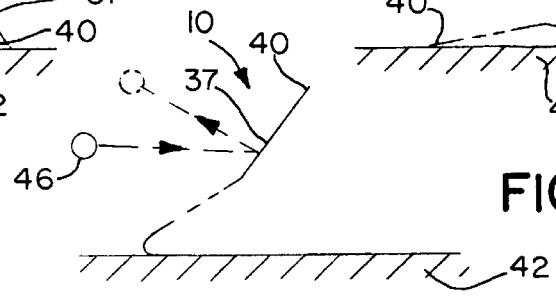
FIG. 7 is a diagrammatic side elevational view of the present invention lying on its front and rebounding a softball off its rear.

As shown in FIG. 7, in which the apparatus for rebounding balls 10 is in the front down position, in which the front section 16 of the frame 12 is resting on the horizontal surface 42 with the horizontal transverse member 40 of the U-shaped member 36 of the rear section 18 of the frame 12 being in the air, the soft ball 46 is rebounding off the rear net section lower portion 37 of the rear net section 22 of the net structure 14.

It will be understood that each of the elements described above, or two or more together, may also find a useful application in other types of constructions differing from the types described above.

While the invention has been illustrated and described as embodied in an apparatus for rebounding balls, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus for rebounding balls having an upright position, said apparatus comprising:

a) a frame comprising a front section being planar and a rear section having an upper portion and a lower portion, said upper portion diverging downwardly rearwardly from said front section and forming an acute angle with said front section when said apparatus is in said upright position, and said lower portion diverging rearwardly downwardly from said upper portion so as to form an obtuse angle with said upper portion; and b) a net structure attached within said front and rear sections so as to form at least two rebound surfaces.

2. The apparatus as defined in claim 1, wherein said frame is tubular.

3. The apparatus as defined in claim 1, wherein said frame comprises a front section that is planar and vertically rearwardly inclined, and a rear section that diverges downwardly rearwardly from said front section and forms an acute angle therebetween when said apparatus is in said upright position.

4. The apparatus as defined in claim 1, wherein said net structure comprises a front net section that is planar, positioned within, and sized to conform to, said front section, and a rear net section positioned within, and sized to conform to, said rear section.

5. The apparatus as defined in claim 1; further comprising means for securing said net structure within said frame.

6. The apparatus as defined in claim 5, wherein said securing means is one of rubber straps and springs.

7. The apparatus as defined in claim 4, wherein said front section comprises a U-shaped member whose horizontal transverse portion is for resting on a horizontal surface and whose vertical leg portions extend vertically-rearwardly-upwardly from opposite ends of said horizontal transverse portion.

8. The apparatus as defined in claim 7, wherein said frame further comprises apex portions that are rearwardly facing and coplanar with said vertical leg portions when said apparatus is in said upright position, said apex portions spanning less than 90 degrees between said front and rear sections.

9. The apparatus as defined in claim 8, wherein said frame further comprises a horizontal cross member that extends from one apex portion to another apex portion, and is parallel to said horizontal transverse portion so as to form a rectilinear shape for said front section.

10. The apparatus as defined in claim 7, wherein said upper portion comprises a pair of members that are parallel and depend coplanarly and rearwardly from said front section at said acute angle when said apparatus is in said upright position.

11. The apparatus as defined in claim 8, wherein said pair of members and said vertical leg portions form equal angles with perpendicular bisectors of said apex portions.

12. The apparatus as defined in claim 10, wherein a portion of said rear net section between said pair of members forms a rear net section upper portion that is planar.

13. The apparatus as defined in claim 12, wherein said upper portion comprises a U-shaped member whose vertical leg portions depend coplanarly and rearwardly, at obtuse angles, from the other ends of said pair of members, and whose horizontal transverse member is for resting on the horizontal surface when said apparatus is in said upright position.

14. The apparatus as defined in claim 13, wherein a portion of said rear net section between said vertical leg portions forms a rear net section lower portion that is planar.

15. The apparatus as defined in claim 14, wherein said horizontal transverse portion and said horizontal transverse member are for resting on the horizontal surface when said apparatus for rebounding balls is in said upright position so as to allow at least one ball to rebound off at least one of said front net section and said rear net section upper portion and said rear net section lower portion.

16. The apparatus as defined in claim 8, wherein said horizontal transverse member and said apex portions are for resting on the horizontal surface with said horizontal transverse portion being in the air so as to allow at least one ball to rebound off said front net section.

17. The apparatus as defined in claim 14, wherein said front section is for resting on the horizontal surface with said horizontal transverse member being in the air so as to allow at least one ball to rebound off said rear net section lower portion.

* * * * *